US010527035B2

(12) United States Patent
Chen et al.

(10) Patent No.: US 10,527,035 B2
(45) Date of Patent: Jan. 7, 2020

(54) ANTI-RIPPLE INJECTION METHOD AND APPARATUS AND CONTROL SYSTEM OF A PUMP

(71) Applicant: EATON CORPORATION, Cleveland, OH (US)

(72) Inventors: Yilun Chen, Shanghai (CN); Xiaomeng Cheng, Shanghai (CN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 878 days.

(21) Appl. No.: 14/900,010

(22) PCT Filed: Jun. 27, 2014

(86) PCT No.: PCT/CN2014/080975

§ 371 (c)(1),
(2) Date: Dec. 18, 2015

(87) PCT Pub. No.: WO2014/206340

PCT Pub. Date: Dec. 31, 2014

(65) Prior Publication Data

US 2017/0298924 A1 Oct. 19, 2017

(30) Foreign Application Priority Data

Jun. 28, 2013 (CN) ..... 2013 1 0268767

(51) Int. Cl.
*F04B 49/06* (2006.01)
*F04B 49/10* (2006.01)
(Continued)

(52) U.S. Cl.
CPC ..... *F04B 49/06* (2013.01); *F04B 17/03* (2013.01); *F04B 49/065* (2013.01); *F04B 49/08* (2013.01);
(Continued)

(58) Field of Classification Search
CPC ..... F04B 11/0041; F04B 17/03–04; F04B 35/04–45; F04B 39/0027; F04B 49/002;
(Continued)

(56) References Cited

U.S. PATENT DOCUMENTS 4,624,625 A * 11/1986 Schrenker ..... F04B 43/067 417/20
4,822,250 A 4/1989 Tsubouchi et al.
(Continued)

FOREIGN PATENT DOCUMENTS

CN 201057139 Y 5/2008
DE 10334817 A1 * 3/2005 ..... F04B 51/00
JP 7-286584 A 10/1995
JP 10-159743 A 6/1998

OTHER PUBLICATIONS

Extended European Search Report for corresponding European Patent Application No. 14817204.2 dated Feb. 13, 2017, 7 pgs.
(Continued)

*Primary Examiner* — Alexander B Comley
(74) *Attorney, Agent, or Firm* — Merchant & Gould P.C.

(57) ABSTRACT

An anti-ripple injection method for injecting an anti-ripple signal into a control system of a pump is disclosed. The control system controls an electric motor via an electric motor drive, and the electric motor drives the pump. The anti-ripple signal causes pressure ripples in the pump output to be at least partially cancelled. The anti-ripple injection method includes: injecting an anti-ripple signal of any waveform into the control system, the anti-ripple signal being represented by the following equation: $f(\theta)=\Sigma_m A_m \cos(m\theta+\theta_m)$, wherein θ is the rotation angle of the motor shaft, m is the order of a signal harmonic in the anti-ripple signal, $A_m$ and $\theta_m$ are parameters with respect to the $m^{th}$ signal harmonic. A control system of a pump including the
(Continued)

anti-ripple injection apparatus, and a pump system including the control system are also disclosed.

18 Claims, 7 Drawing Sheets

(51) Int. Cl.
*F04B 17/03* (2006.01)
*F04B 49/08* (2006.01)
*F04B 49/20* (2006.01)
*F04C 14/08* (2006.01)
*F04C 15/00* (2006.01)

(52) U.S. Cl.
CPC ..... *F04B 49/103* (2013.01); *F04B 49/20* (2013.01); *F04C 14/08* (2013.01); *F04B 2201/1208* (2013.01); *F04B 2203/0201* (2013.01); *F04B 2203/0209* (2013.01); *F04B 2205/05* (2013.01); *F04B 2205/13* (2013.01); *F04C 15/008* (2013.01); *F04C 2270/095* (2013.01)

(58) Field of Classification Search
CPC ..... F04B 49/06–08; F04B 49/20; F04B 2201/1208; F04B 2205/05; F04B 2201/13; F04D 13/06; F04D 13/064; F04D 15/0066; F04C 14/08; F04C 14/24; F04C 14/28; F04C 28/08; F04C 28/24; F04C 28/28
USPC ..... 417/18, 22, 38, 42, 44.1–44.11
See application file for complete search history.

(56) References Cited

U.S. PATENT DOCUMENTS 5,108,264 A * 4/1992 Abdel-Rahman ..... F04B 11/0075 417/20
5,668,457 A * 9/1997 Motamed ..... F04B 49/065 318/606
5,971,714 A * 10/1999 Schaffer ..... F04B 11/0041 417/44.2
2003/0205044 A1* 11/2003 Franz ..... F03C 1/0697 60/445
2004/0217191 A1* 11/2004 Muratsubaki ..... F04B 49/065 239/101
2006/0251523 A1* 11/2006 Lee ..... F04B 35/045 417/44.1
2007/0020108 A1* 1/2007 Walls ..... F04B 49/022 417/44.2
2009/0304523 A1 12/2009 Morsch et al.
2012/0189463 A1* 7/2012 Toyota ..... F04B 49/022 417/1
2013/0002187 A1* 1/2013 Spreen ..... H02P 23/0077 318/811
2013/0183167 A1* 7/2013 Werner ..... F04B 49/022 417/53
2013/0205763 A1* 8/2013 Caldwell ..... F15B 15/20 60/327

OTHER PUBLICATIONS

International Search Report for corresponding International Patent Application No. PCT/CN2014/080975 dated Sep. 15, 2014.

* cited by examiner

ANTI-RIPPLE INJECTION METHOD AND APPARATUS AND CONTROL SYSTEM OF A PUMP

This application is a National Stage Application of PCT/CN2014/080975, filed 27 Jun. 2014, which claims benefit of Serial No. 201310268767.8, filed 28 Jun. 2013 in China and which applications are incorporated herein by reference. To the extent appropriate, a claim of priority is made to each of the above disclosed applications.

FIELD OF THE INVENTION

This invention relates to a pump, particularly to an anti-ripple injection method and apparatus as well as a control system of a pump

BACKGROUND OF THE INVENTION

Flow ripples or pressure ripples (fluctuations) generated from the hydraulic pump are the source of system vibrations and noises in a hydraulic system. Pressure ripples are also disturbance to motion control that affects the precision and repeatability of the movement.

FIG. 1 illustrates structures and flow ripple patterns of different types of hydraulic pumps. As shown, for the external gear pump, axial piston pump and vane pump, although the required flows are constant, the actual flows fluctuate with rotation of the pumps, which is caused by the mechanical structures of the pumps.

Noises impact human hearing health; vibrations reduce the reliability of the entire system; and the reduced precision directly affects the product quality produced by the hydraulic machine. From every aspect, pressure ripples reduce values delivered to customers. Therefore, pressure ripple reduction has been a core issue that researchers from both academic and industry world have tried to solve.

Most current methods for reduction of flow and pressure ripples are based on novel mechanical designs or additional ripple compensators such as silencers or accumulators. These methods in general suffer from trade-offs among the costs, energy efficiency and system dynamic responses. For example, the method modifying pump shaft design lowers the energy efficiency; adding a pre-compression chamber produces additional manufacturing and component costs and reduces the efficiency; adding an accumulator or silencer at the pump outlet increases component costs and space and lowers pump dynamics.

Thus, a solution for reducing noises and vibrations of a pump with higher efficiency and lower costs is needed in the art.

SUMMARY OF THE INVENTION

In one aspect of the present invention, there is provided an anti-ripple injection method for injecting an anti-ripple signal into a control system of a pump, the control system controlling an electric motor via an electric motor drive, the electric motor driving the pump, the anti-ripple signal causing pressure ripples in the pump output to be at least partially cancelled, the anti-ripple injection method comprising: injecting an anti-ripple signal of any waveform into the control system, the anti-ripple signal being represented by the following equation:

$$f(\theta)=\Sigma_m A_m \cos(m\theta+\theta_m),$$

wherein θ is the rotation angle of the motor shaft, m is the order of a signal harmonic wave in the anti-ripple signal, $A_m$ and θm are parameters with respect to the $m^{th}$ signal harmonic wave.

In another aspect of the present invention, there is provided an anti-ripple injection apparatus for injecting an anti-ripple signal into a control system of a pump, the control system controlling an electric motor via an electric motor drive, the electric motor driving the pump, the anti-ripple signal causing pressure ripples in the pump output to be at least partially cancelled, the anti-ripple injection apparatus comprising: an injection module configured to inject an anti-ripple signal of any waveform into the control system, the anti-ripple signal being represented by the following equation:

$$f(\theta)=\Sigma_m A_m \cos(m\theta+\theta_m),$$

wherein θ is the rotation angle of the motor shaft, m is the order of the signal harmonic wave in the anti-ripple signal, $A_m$ and θm are parameters with respect to the $m^{th}$ signal harmonic wave.

In yet another aspect of the present invention, there is provided a control system of a pump, comprising: the anti-ripple injection apparatus above.

In a further aspect of the present invention, there is provided a pump system, comprising: an electric drive, an electric motor, and a pump, wherein the electric drive comprises the control system above.

Advantages of the present invention comprise at least one of the following: effectively reducing noises and vibrations of the pump system, increasing the control precision, stability, repeatability and service life of the system; enhancing customer values; being a low-cost solution; not harming dynamics of the system; needing no additional components and extra space.

BRIEF DESCRIPTION OF THE ACCOMPANYING DRAWINGS

DETAILED DESCRIPTION OF EXEMPLARY EMBODIMENTS

The embodiments of the present invention are described below by referring to figures. Numerous details are described below so that those skilled in the art can comprehensively understand and realize the present invention.

However, it is apparent for those skilled in the art that the realization of the present invention may not include some of the details. In addition, it should be understood that the present invention is not limited to the described specific embodiments. On the contrary, it is contemplated that the present invention can be realized using any combination of the features and elements described below, no matter whether they relate to different embodiments or not. Therefore, the following aspects, features, embodiments and advantages are only for explanation, and should not be taken as elements of or limitations to the claims, unless explicitly stated otherwise in the claims.

Figure 1:
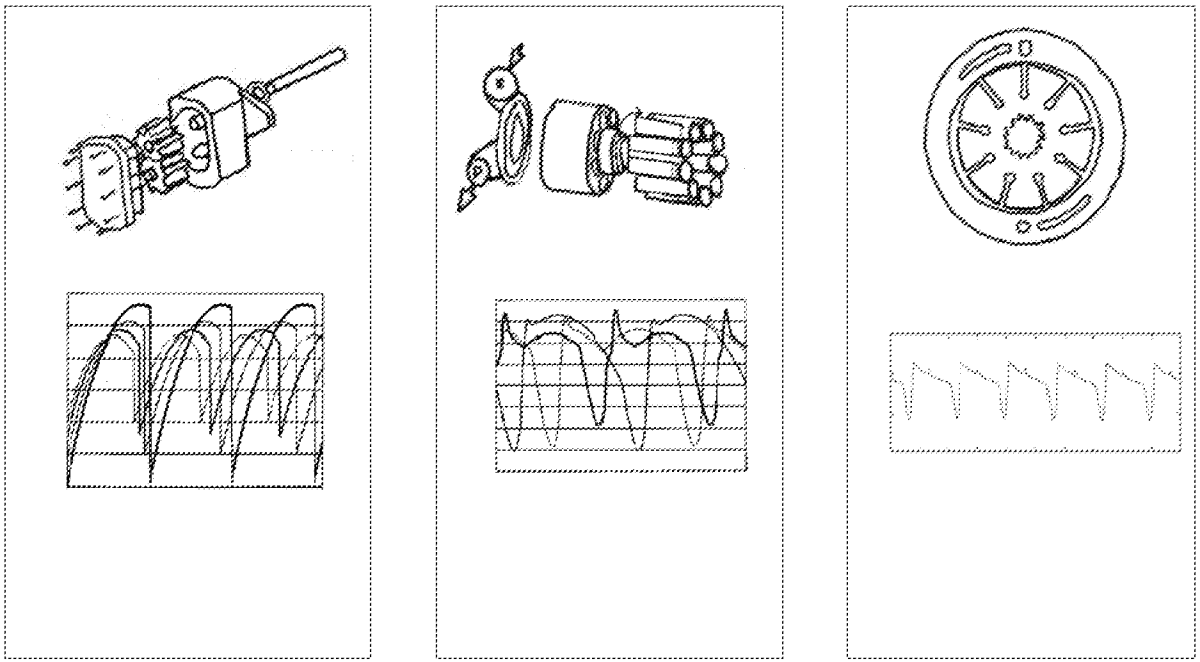
FIG. 1 illustrates the structures and flow ripple patterns of different types of hydraulic pumps.
Figure 2:
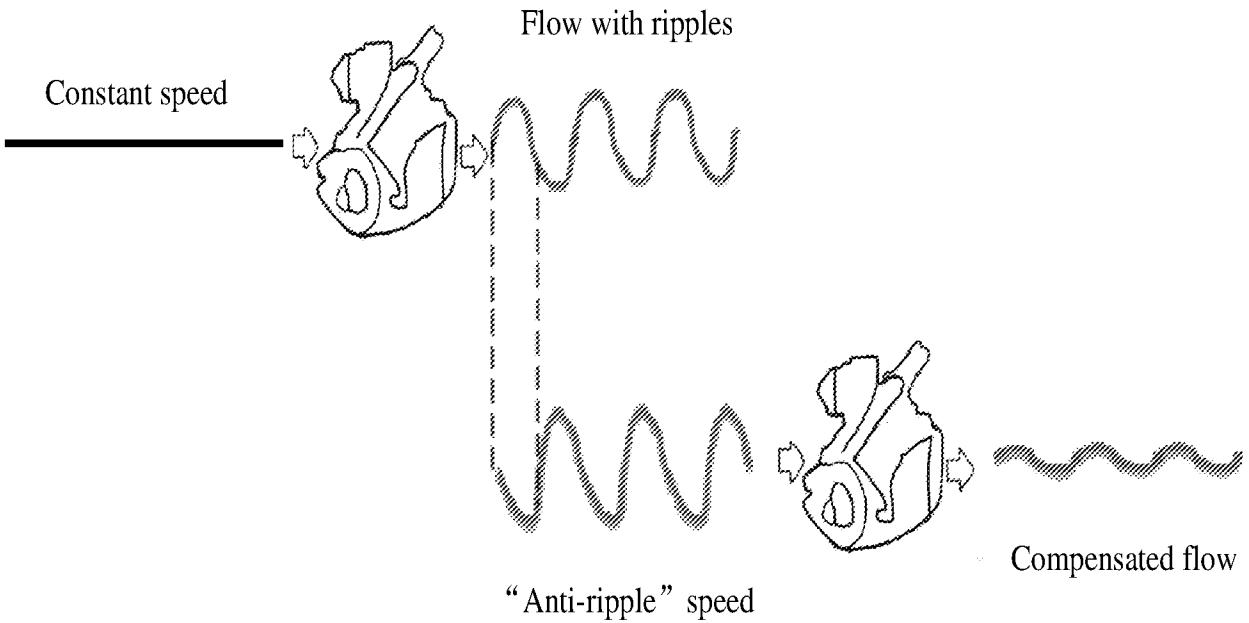
FIG. 2 illustrates the basic idea of the present invention to inject an anti-ripple signal into the control system of a hydraulic pump to cancel flow and pressure ripples outputted by the hydraulic pump.

In view that currently more and more hydraulic pumps are driven by VFDs to achieve flexible speed or torque control, the present invention proposes a solution of reduction of noises and vibrations of a hydraulic pump by means of a control solution applied to the VFD, which does not need additional hardware costs. FIG. 2 illustrates the basic idea of the present invention in the control system. As shown, the hydraulic pump system receives a constant rotation speed signal, but generates a liquid flow with ripples. The solution of the present invention injects an anti-ripple signal into the control system of the hydraulic pump such that ripples in the flow and pressure outputted by the hydraulic pump are notably cancelled.

Figure 3:
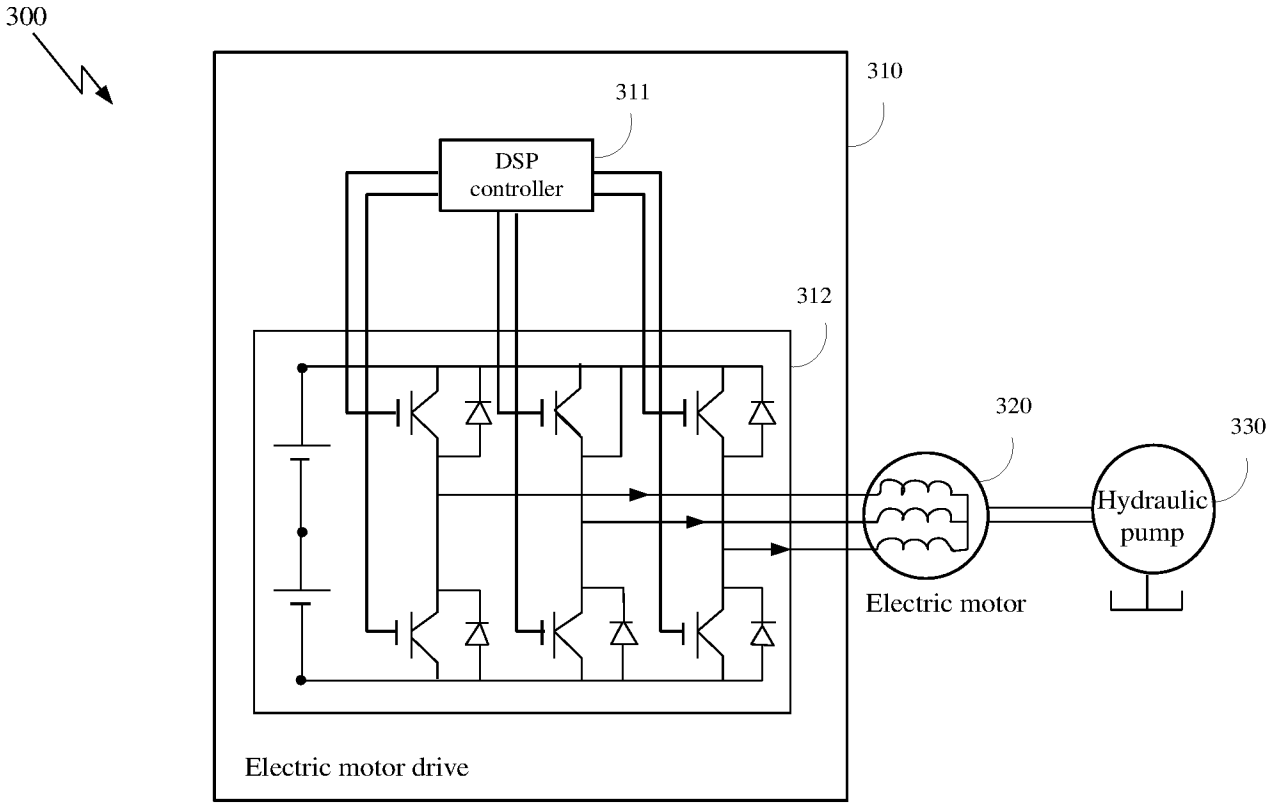
FIG. 3 illustrates a schematic diagram of a hydraulic pump system according to an embodiment of the present invention.

Now referring to FIG. 3, it illustrates a schematic diagram of a hydraulic pump system 300 according to an embodiment of the present invention. As shown, the hydraulic pump system 300 comprises an electric drive 310, an electric motor 320, and a hydraulic pump 330, wherein the electric drive 310 controls the operation of the electric motor 320 and the electric motor 320 drives the hydraulic pump 330.

The hydraulic pump 330 may be any appropriate hydraulic pump applicable in any actual situation, such as a piston pump, gear pump, vane pump, etc. The electric motor 320 may be any appropriate electric motor suitable to be driven by a VFD, such as a permanent magnetic synchronous motor, a three-phase AC asynchronous motor or the like. The electric drive 310 may also be called an electric motor controller, and is a VFD, such as a servo drive or the like, in an embodiment of the present invention. As shown in the figure and known by those skilled in the art, the VFD comprises a digital signal processing (DSP) controller 311 and an Insulated Gate Bipolar Transistor (IGBT) drive circuit 312. The DSP controller 311 generates a PWM signal based on a command of rotation speed, pressure or the like inputted by a user, and the PWM signal controls on and off of the transistors in the IGBT drive circuit 312 so as to drive the electric motor to rotate with an appropriate current and/or voltage.

The control system according to an embodiment of the present invention may be within the DSP controller 311 and implemented by software code in the DSP controller 411. Off course, it may also be contemplated that the software code has been hardwired into the DSP controller hardware, in which case, the control system will be implemented by hardware.

Figure 4:
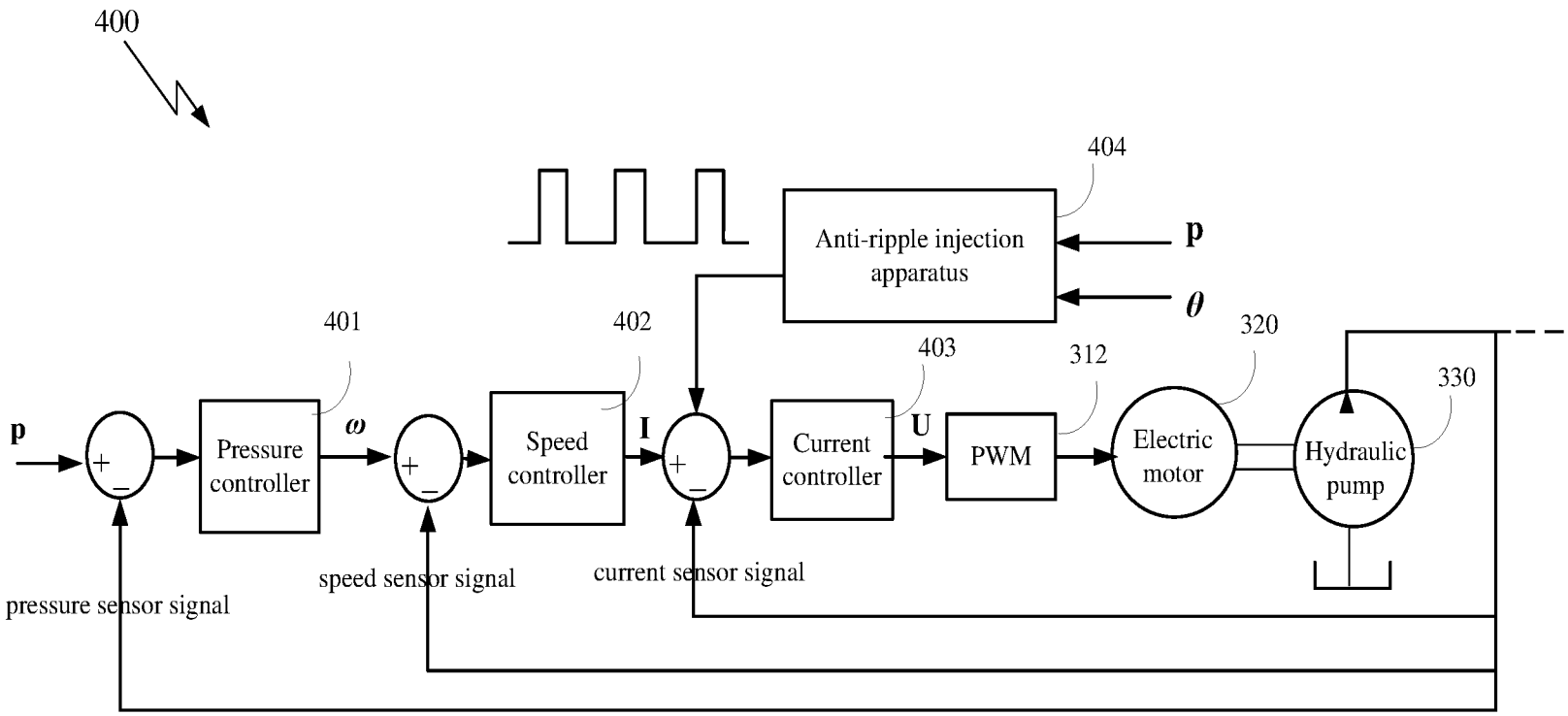
FIG. 4 illustrates a schematic diagram of the control system according to an embodiment of the present invention.

Now referring to FIG. 4, it illustrates a schematic diagram of the control system 400 according to an embodiment of the present invention. As shown, the control system 400 comprises a pressure controller 401, a speed controller 402, a current controller 403, and an anti-ripple injection apparatus 404.

The pressure controller 401 receives a combination of a fourth control signal (e.g. a target pressure value at the outlet of the hydraulic pump, set by a user) and a pressure feedback signal from a pressure sensor at the outlet of the hydraulic pump as input, and outputs a third control signal. The pressure controller 401 may be any appropriate existing (or newly developed) pressure controller, such as a PID (Proportion Integration Differentiation) controller.

The speed controller 402 receives a combination of the third control signal outputted by the pressure controller 401 and a speed feedback signal from a speed sensor at the output of the electric motor as input, and outputs a second control signal. The speed controller 402 may be any appropriate existing (or newly developed) speed controller, such as a PI (Proportion Integration) controller.

The current controller 403 receives a combination of the second control signal outputted by the speed controller 402, a current feedback signal from a current sensor at the input of the electric motor and a current anti-ripple signal from the anti-ripple injection apparatus 404 as input, and outputs a first control signal. The first control signal drives the electric motor to rotate via a PWM drive circuit (i.e. IGBT drive circuit), and the electric motor in turn drives the hydraulic pump to operate. The current controller 402 can be any appropriate existing (or newly developed) current controller, such as, PI (Proportion Integration) controller. The current at the input of the electric motor is in proportion to the torque of the electric motor, so that control of the current is equivalent to control of the torque, and the current controller may also be called a torque controller.

According to an embodiment of the present invention, the anti-ripple injection apparatus 404 generates the current anti-ripple signal based on a rotation angle signal $\theta$ of the motor shaft, a rotation speed signal $\omega$ of the electric motor, and an outlet pressure signal p of the hydraulic pump, and injects the current anti-ripple signal into the current loop of the control system, that is, the anti-ripple signal is combined with the second control signal and the current feedback signal at the input of the current controller 403 to be provided to the current controller 403. The rotation angle signal $\theta$ of the motor shaft may come from an angle sensor or speed sensors installed on the electric motor; the rotation speed signal $\omega$ of the electric motor may come from a speed sensor installed on the electric motor or may be obtained by computing the changing rate over time of the angle signal $\theta$; and the outlet pressure signal p of the hydraulic pump may come from a pressure sensor installed at the output of the hydraulic pump.

Figure 5:
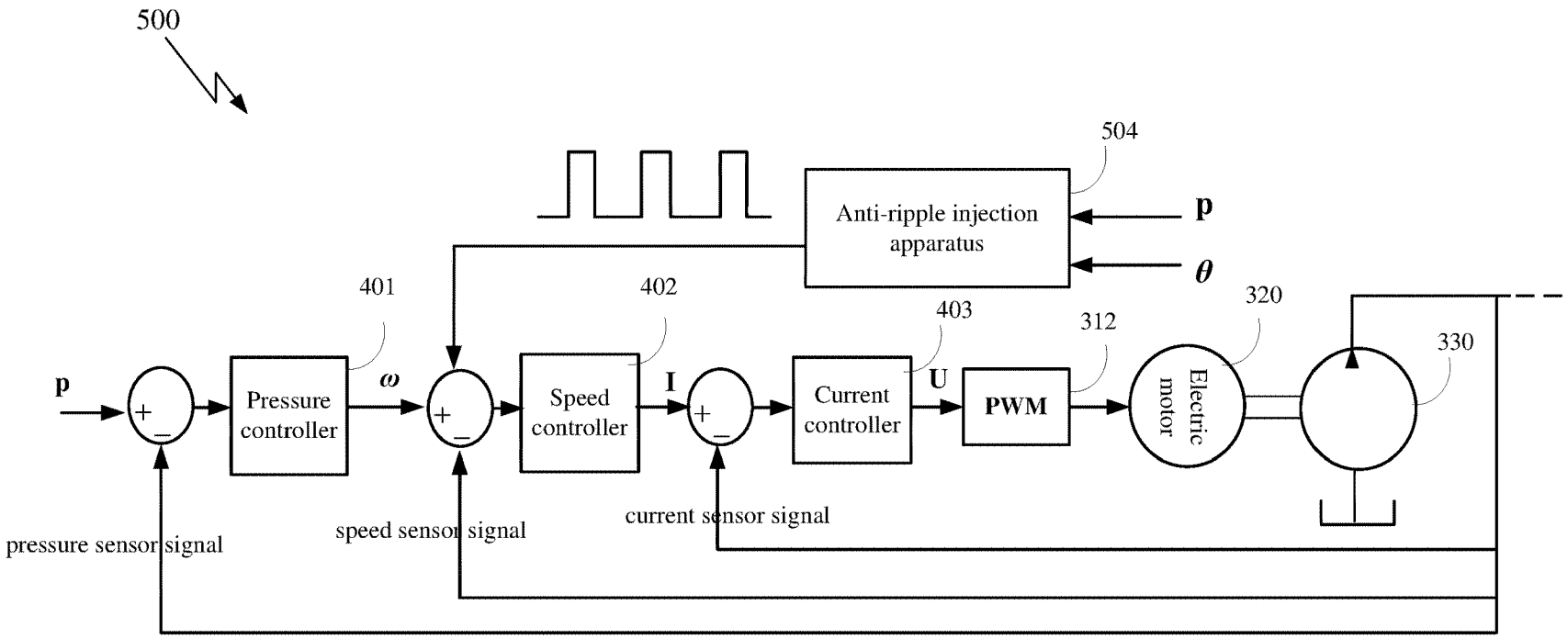
FIG. 5 illustrates a schematic diagram of the control system according to another embodiment of the present invention.

Now referring to FIG. 5, it illustrates a schematic diagram of the control system 500 according to another embodiment of the present invention. As shown, the control system comprises a pressure controller 401, a speed controller 402, a current controller 403, and an anti-ripple injection apparatus 504. The control system differs from the control system shown by FIG. 4 in that the anti-ripple injection apparatus 504 injects a speed anti-ripple signal into the speed loop instead of the current loop.

The pressure controller 401 is the same as the pressure controller 401 shown in FIG. 4, and is not described further in detail.

The speed controller 402 receives a combination of a third control signal outputted by the pressure controller 401, a speed feedback signal from a speed sensor at the output of the electric motor and a speed anti-ripple signal from the anti-ripple injection apparatus 504 as input, and outputs a second control signal.

The current controller 403 receives a combination of the second control signal outputted by the speed controller 402 and a current feedback signal from a current sensor at the input of the electric motor as input, and outputs a first control signal. The first control signal drives the electric motor to rotate via the PWM drive circuit (i.e. IGBT drive circuit), which in turn drives the hydraulic pump to operate.

According to this embodiment of the present invention, the anti-ripple injection apparatus 504 generates a speed anti-ripple signal based on a rotation angle signal θ of the motor shaft, a rotation speed signal ω of the electric motor, and an outlet pressure signal p of the hydraulic pump, and injects the speed anti-ripple signal into the speed loop of the control system, that is, the anti-ripple signal is combined with the second control signal and the current feedback signal at the input of the current controller 403 to be provided to the current controller 403.

According to an embodiment of the present invention, the core module of the present invention is the anti-ripple injection apparatus 404, 504. All the other modules may be a conventional implementation of the "pressure closed-loop control" that has been widely used in industrial machines and other related applications, or a conventional implementation of the "flow closed-loop control" or "rotation speed closed-loop control". In addition, as known by those skilled in the art, the structure of the control system illustrated in FIGS. 4 and 5 and described above is only exemplary, rather than limitation to the present invention. For example, the positional relation between the pressure controller 401 and the speed controller 402 may be contrary to that is illustrated and described; the control system may not include any or both of the pressure controller 401 and the speed controller 402; the control system may also include other controllers, other components or control loops, and so on.

Choice between the two embodiments (i.e. injecting the speed anti-ripple signal into the speed loop or injecting the current anti-ripple signal into the current loop) of the present invention described above depends on the frequency of the outlet pressure (or flow) ripples of the hydraulic pump in the time domain. In general, the current control loop has a much higher bandwidth (up to 1 KHz) than that of the speed control loop (about 100 Hz). As a rule of thumb, for a piston pump with 9 pistons, the speed anti-ripple signal injection method may be adopted when the rotating speed is less than 300 rpm, and the current anti-ripple signal injection method may be adopted when the rotating speed is less than 3000 rpm.

As described above, the function of the anti-ripple injection apparatus 404, 504 is to obtain the pressure signal from a pressure sensor and the angle signal from an angle sensor, and based on these, to compute an anti-ripple signal to modify the second or third control signal. As ripple generation in flow and pressure outputted by the hydraulic pump depends on the internal structure of the hydraulic pump, according to an embodiment of the present invention, the anti-ripple signal generated by the anti-ripple injection apparatus 404, 504 is a periodic function of the rotation angle of the motor shaft instead of a periodic function of time.

For both the speed anti-ripple signal injection and the current anti-ripple signal injection, three core elements of the anti-ripple signal to be injected need to be determined: 1) the waveform of the ant-ripple signal, 2) the amplitude of the anti-ripple signal waveform, and 3) the time offset of the anti-ripple signal waveform. In an embodiment of the present invention, a sinusoidal signal is used as the waveform of a anti-ripple signal component. This is based on the principle that any periodical signal can be decomposed as a set of sinusoidal harmonic signals. Of course, in other embodiments of the present invention, other periodic signals, such as a square waveform, a triangle waveform or the like, may be chosen as the waveform of an anti-ripple signal component. And the automatic parameter tuning method described below is also applicable to other periodic signals.

According to an embodiment of the present invention, the anti-ripple signal to be injected can be expressed by the following equation:

$$f(\theta)=A_m \cos(m\theta+\theta_m),$$

wherein θ is the rotation angle of the motor shaft, m is the harmonic order of the anti-ripple signal component, and $A_m$ and bin are parameters to be determined.

Figure 6:
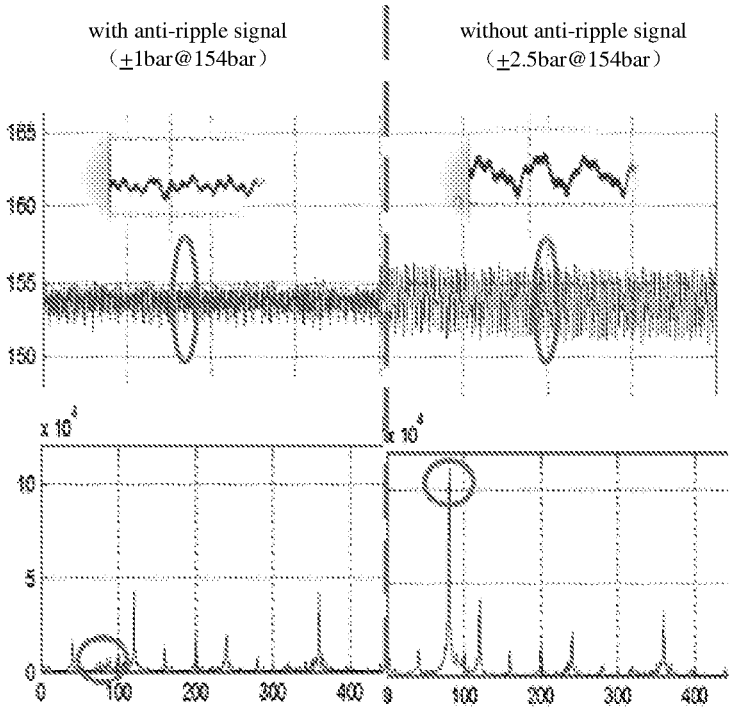
FIG. 6 illustrates a diagram of measured data from a pressure sensor in a test demo hydraulic pump system.

FIG. 6 illustrates a diagram of measured data from pressure sensors in a test demo hydraulic pump system. The upper part of the diagram shows a comparison between the pressure signal with anti-ripple signal injection of the present invention and the pressure signal without anti-ripple signal injection of the invention. As can be seen, the anti-ripple signal injection of the present invention is able to reduce as much as 60% of pressure ripples. The lower part of the diagram is a spectrum analysis of the ripple signals. From the figure, it can be seen that the 2nd order harmonic in the pressure ripples has been completely cancelled by the anti-ripple signal injection of the present invention.

Below is described an anti-ripple injection method for injecting an anti-ripple signal into a control system of a pump according to an embodiment of the present invention, the control system controlling an electric motor via an electric motor drive, the electric motor driving the pump, the anti-ripple signal causing pressure ripples in the pump output to be at least partially cancelled, the anti-ripple injection method comprising: injecting an anti-ripple signal of any waveform into the control system, the anti-ripple signal being represented by the following equation:

$$f(\theta)=\Sigma_m A_m \cos(m\theta+\theta_m),$$

wherein θ is the rotation angle of the motor shaft, m is the order of a signal harmonic in the anti-ripple signal, $A_m$ and $\theta_m$ are parameters with respect to the $m^{th}$ signal harmonic. That is, in the embodiment of the present invention, the anti-ripple signal to be injected comprises one or more harmonic components.

According to an embodiment of the present invention, the parameters of the anti-ripple signal are automatically set according to the output signal of a system sensor without any manual adjustment. The system sensor includes any one or more of the following: a pressure sensor, an angle sensor, a speed sensor, a current sensor, and a voltage sensor.

According to an embodiment of the present invention, the method further comprises determining the $A_m$ and $\theta_m$ by extracting the corresponding parameters of the $m^{th}$ signal harmonic from a pressure ripple signal. The pressure ripple signal may come from a pressure sensor. That is, a spectrum analysis may be performed on the detected pressure rippled signal outputted by the hydraulic pump to extract the harmonic components and obtain the magnitudes and phases thereof, and then construct the respective anti-ripple signal components with the same magnitudes and phases, and form the anti-ripple signal from the respective anti-ripple signal components, wherein the respective anti-ripple signal components are for eliminating the corresponding harmonic components in the pressure rippled signal.

A spectrum analysis may be performed on the pressure rippled signal in various ways to obtain the magnitudes and phases of the respective harmonic components. In an embodiment of the present invention, the Fast Fourier Transform (FFT) is used to perform a spectrum analysis on pressure rippled signal.

In another embodiment of the present invention, a digital Phase-Locked Loop (PLL) is used for performing a spectrum analysis on the pressure rippled signal to obtain the magnitudes and phases of the harmonic components.

According to an embodiment of the present invention, the digital PLL is based on the following formulas:

$$\int_0^{2\pi} f(\theta)\cos(m\theta)d\theta = \tfrac{1}{2}A_m \cos(\theta_m),$$

$$\int_0^{2\pi} f(\theta)\sin(m\theta)d\theta = -\tfrac{1}{2}A_m \sin(\theta_m),$$

wherein, θ is the rotation angle of the motor shaft, f (θ) is a pressure rippled signal as a function of θ, m is the order of a signal harmonic in the pressure rippled signal, $A_m$ is the magnitude of the $m^{th}$ signal harmonic, $\theta_m$ is the phase of the $m^{th}$ signal harmonic.

As known by those skilled in the art, these formulas may be derived from the mathematical expression $f(\theta)=\Sigma_m A_m \cos(m\theta+\theta_m)$ of the pressure rippled signal and the digital PLL can solve the formula through numerical integration.

The method of the present invention is based on the following two assumptions: 1) The control system is well approximated by a linear time invariant system; 2) The electric motor rotates at a relatively constant speed at the operation point of interest. For assumption 1), experiment results have shown that in a motor-pump joint control system, the system may be well modeled by a LTI system. For assumption 2), the "relatively constant" refers to the relative speed variation being less than ~10-20% percent. Field tests and analysis show that the two assumptions hold true generally.

In order to better cancel the respective signal harmonics in the pressure ripple signal, according to an embodiment of the present invention, a three-step try-and-learn method is proposed to obtain the parameters $A_m$ and $\theta_m$:

Step 1: Perform spectrum analysis on the $m^{th}$ signal harmonic in the pressure rippled signal to obtain the amplitude and phase thereof. This step may be achieved by either FFT or digital PLL;

Step 2: Inject into the control system an anti-ripple signal expressed by $B_m/G_m \cos(m\theta+\phi_m)$ based on $(B_m, \phi_m)$ and a gain $G_m$ from a corresponding node to the pressure node in the control system. For the current anti-ripple signal injection, the corresponding node is a current node; and for the speed anti-ripple signal injection, the corresponding node is a speed node;

Step 3: Use spectrum analysis to calculate the $m^{th}$ pressure signal harmonic in the pressure ripple signal to obtain an updated magnitude $C_m$ and phase $\psi_m$ thereof. This may also be achieved by either FFT or digital PLL.

The following equation may be used to calculate the parameters $A_m$ and θm of the anti-ripple signal to be injected with respect to the $m^{th}$ signal harmonic:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{B_m}{G_m} e^{j\phi_m}.$$

According to an embodiment of the present invention, the steps 1-4 above are performed simultaneously for the signal harmonics of the respective orders in the pressure rippled signal, i.e. simultaneously determining the corresponding parameters $A_m$ and θm of the signal harmonics of the respective orders, and the time required is the same as that for determining a signal harmonic of a single order of, and mainly depends on the spectrum analysis, such as FFT or digital PLL.

For high gain control, $G_m$ is small and thus may be sensitive. In this case, the following formula is substituted for the above formula to determine $x_1$, $$x_1 = \frac{G_m B_m}{G_m^2 + \in} e^{j\phi_m},$$

wherein, ∈ is an arbitrarily small number.

The anti-ripple injection method according to embodiments of the present invention is described above. The anti-ripple injection method can be implemented by anti-ripple injection apparatuses 404, 504 according to embodiments of the present invention. As known by those skilled in the art, the method may be implemented by programming a DSP controller in an electric motor drive driving an electric motor. The programming may be embodied as program code stored in the DSP controller, or hardwired into the DSP controller hardware. In addition, it should be pointed out that the description above is only exemplary, not limitation to the present invention. In other embodiments of the present invention, the method may have more, less or different steps, and the including, sequential and functional relations among these steps may be different from that described in the present invention.

Figure 7:
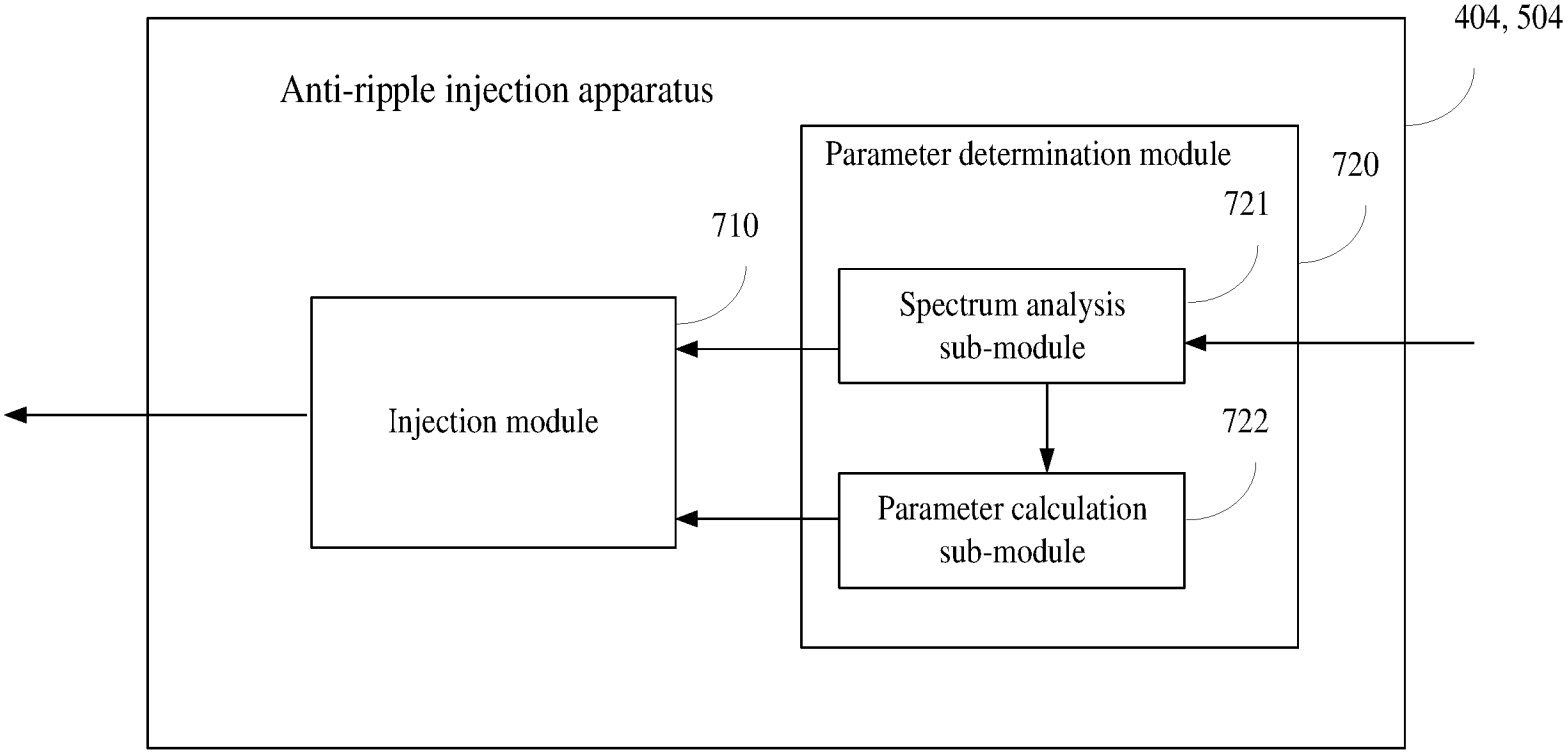
FIG. 7 illustrates a schematic structural diagram of the anti-ripple injection apparatus according to embodiments of the present invention.

Now referring to FIG. 7, it illustrates an exemplary structure diagram of the anti-ripple injection apparatus 404, 504 for injecting an anti-ripple signal into a control system of a pump according to an embodiment of the present invention, the control system controlling an electric motor via an electric motor drive, the electric motor driving the pump, the anti-ripple signal causing pressure ripples in the pump output to be at least partially cancelled, the anti-ripple injection apparatus comprising: an injection module configured to inject an anti-ripple signal of any waveform into the control system, the anti-ripple signal being represented by the following equation:

$$f(\theta)=\Sigma_m A_m \cos(m\theta+\theta_m),$$

wherein θ is the rotation angle of the motor shaft, m is the order of the signal harmonic in the anti-ripple signal, $A_m$ and θm are parameters with respect to the $m^{th}$ signal harmonic.

According to an embodiment of the present invention, the parameters of the anti-ripple signal are automatically set according to the output signal of a system sensor without any manual adjustment.

According to an embodiment of the present invention, the system sensor comprises any one or more of the following: a pressure sensor, an angle sensor, a speed sensor, a current sensor, and a voltage sensor.

According to an embodiment of the present invention, the anti-ripple injection apparatuses 404, 504 further comprise: a parameter determination module 720 configured to determine the $A_m$ and θm by extracting the corresponding parameters of the $m^{th}$ signal harmonic from a pressure ripple signal.

According to an embodiment of the present invention, the parameter determination module 720 comprises a spectrum analysis sub-module 721 and a parameter calculation sub-module 722, wherein the spectrum analysis sub-module 721 is configured to perform spectrum analysis on the $m^{th}$ signal harmonic in the pressure ripple signal to obtain the magnitude $B_m$ and phase $\phi_m$ thereof;

the injection module 722 is further configured to inject into the control system an anti-ripple signal represented by $B_m/G_m \cos(m\theta+\phi_m)$ based on $(B_m, \phi_m)$ and a gain $G_m$ from the corresponding node to the pressure node in the control system;

the spectrum analysis sub-module 710 is further configured to calculate the $m^{th}$ signal harmonic in the pressure ripple signals using spectrum analysis to obtain an updated magnitude $C_m$ and phase $\psi_m$ thereof;

the parameter calculation sub-module 722 is configured to calculate with the following equation parameters $A_m$ and θm of the anti-ripple signal to be injected with respect to the $m^{th}$ signal harmonic:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{B_m}{G_m} e^{j\phi_m}.$$

According to some other embodiments of the present invention, the parameter calculation sub-module 723 is configured to calculate with the following equation parameters $A_m$ and θm of the anti-ripple signal to be injected with respect to the $m^{th}$ signal harmonic:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{G_m B_m}{G_m^2 + \in} e^{j\phi_m},$$

wherein, ∈0 is an arbitrarily small number.

According to an embodiment of the present invention, the parameter determination module 720 is further configured to simultaneously perform the determination of the $A_m$ and θm by extracting corresponding parameters of the $m^{th}$ signal harmonic from a pressure ripple signal, with respect to a set of different $m^{th}$ signal harmonics in the pressure ripple signal.

According to an embodiment of the present invention, the spectrum analysis sub-module 721 performs spectrum analysis by the Fast Fourier Transform.

According to an embodiment of the present invention, the spectrum analysis sub-module 721 performs spectrum analysis by the digital Phase-Locked Loop (PLL).

According to an embodiment of the present invention, the digital PLL is based on the following formulas:

$$\int_0^{2\pi} f(\theta)\cos(m\theta)d\theta = \frac{1}{2}A_m\cos(\theta_m),$$

$$\int_0^{2\pi} f(\theta)\sin(m\theta)d\theta = -\frac{1}{2}A_m\sin(\theta_m),$$

wherein, θ is the rotation angle of the motor shaft, f (θ) is a pressure ripple signal as a function of θ, m is the order of the signal harmonics in the pressure ripple signals, $A_m$ is the magnitude of the $m^{th}$ signal harmonic, $\theta_m$ is the phase of the $m^{th}$ signal harmonic.

According to an embodiment of the present invention, the injection module 710 is further configured to inject the anti-ripple signal into a speed loop of the control system.

According to an embodiment of the present invention, the injection module 710 is further configured to inject the anti-ripple signal into a current loop of the control system.

As described above, in another aspect, the present invention provides a control system of a VFD-based hydraulic pump, comprising: the anti-ripple injection apparatus according to an embodiment of the present invention.

In yet another aspect, the present invention further provides a pump system, comprising: an electric motor drive, an electric motor, and a pump, wherein the electric motor drive comprises the control system above.

An anti-ripple injection apparatus, a control system of a VFD-based hydraulic pump and a hydraulic pump system according to embodiments of the present invention are described above. It should be pointed out that the description above is only exemplary, not limitation to the present invention. In other embodiments of the present invention, the apparatus and system may have more, less or different modules, and the including, connecting and functional relations among these modules may be different from that described herein. For example, usually a function performed by one module may also be performed by another module, and different modules may be combined or split arbitrarily, and so on.

Exemplary embodiments of the present invention are described above, but the present invention is not limited to this. Those skilled in the art may make various changes and modifications without diverging from the spirit and scope of the present invention. For example, it is contemplated that the technical solution of the present invention is also applicable to other fluid pumps apart from the hydraulic pump. The scope of the present invention is only defined by the claims.

The invention claimed is:

1. An anti-ripple injection method for injecting an anti-ripple signal into a control system of a pump, the control system controlling an electric motor via an electric motor drive, the electric motor driving the pump to produce a pump output, the anti-ripple injection method comprising:

injecting an anti-ripple signal of any waveform into the control system, the anti-ripple signal being represented by the following equation:

$$f(\theta)=\Sigma_m A_m \cos(m\theta+\theta_m),$$

wherein θ is a rotation angle of a motor shaft, m is the order of a signal harmonic in the anti-ripple signal, $A_m$ is the magnitude of the $m^{th}$ signal harmonic, and $\theta_m$ is the phase of the $m^{th}$ signal harmonic; and determining $A_m$ and $\theta_n$ by extracting the corresponding parameters of the $m^{th}$ signal harmonic from a pressure ripple signal, wherein determining $A_m$ and $\theta_m$ includes performing a spectrum analysis on the pressure ripple signal to extract $A_m$ and $\theta_m$, and the anti-ripple signal causing pressure ripples in the pump output to be at least partially cancelled.

2. The anti-ripple injection method according to claim 1, wherein the parameters of the anti-ripple signal are automatically set according to an output signal of a system sensor without any manual adjustment.

3. The anti-ripple injection method according to claim 2, wherein the system sensor includes any one or more of the following: a pressure sensor, an angle sensor, a speed sensor, a current sensor, and a voltage sensor.

4. The anti-ripple injection method according to claim 1, wherein determining $A_m$ and $\theta_m$ by extracting the corresponding parameters of the $m^{th}$ signal harmonic from a pressure ripple signal comprises:

performing spectrum analysis on the $m^{th}$ signal harmonic in the pressure ripple signal to obtain the magnitude $B_m$ and phase $\phi_m$ thereof;

injecting into the control system an anti-ripple signal represented by $B_m/G_m \cos(m\theta+\phi_m)$ based on $(B_m, \phi_m)$ and a gain $G_m$ from a corresponding node to a pressure node in the control system;

calculating the $m^{th}$ signal harmonic in the pressure ripple signal using spectrum analysis to obtain an updated magnitude $C_m$ and phase $\psi_m$ thereof;

calculating parameters $A_m$ and $\theta_m$ of the anti-ripple signal to be injected with respect to the $m^{th}$ signal harmonic, using the following equation:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{B_m}{G_m} e^{j\phi_m}.$$

5. The anti-ripple injection method according to claim 4, wherein determining $A_m$ and $\theta_m$ by extracting the corresponding parameters of the $m^{th}$ signal harmonic from a pressure ripple signal is performed simultaneously with respect to a set of different $m^{th}$ signal harmonics in the pressure ripple signal.

6. The anti-ripple injection method according to claim 4, wherein the spectrum analysis is realized by a Fast Fourier Transform.

7. The anti-ripple injection method according to claim 4, wherein the spectrum analysis is realized by a digital Phase-Locked Loop (PLL).

8. The anti-ripple injection method according to claim 7, wherein the digital PLL is based on the following formulas:

$$\int_0^{2\pi} f(\theta)\cos(m\theta)d\theta = \frac{1}{2} A_m \cos(\theta_m),$$

$$\int_0^{2\pi} f(\theta)\sin(m\theta)d\theta = -\frac{1}{2} A_m \sin(\theta_m),$$

wherein, $\theta$ is the rotation angle of the motor shaft, $f(\theta)$ is a pressure ripple signal as a function of $\theta$, m is the order of a signal harmonic in the pressure ripple signal, $A_m$ is the magnitude of the $m^{th}$ signal harmonic, $\theta_n$ is the phase of the $m^{th}$ signal harmonic.

9. The anti-ripple injection method according to claim 1, wherein determining $A_m$ and $\theta_m$ by extracting the corresponding parameters of the $m^{th}$ signal harmonic from a pressure ripple signal comprises:

performing spectrum analysis on the $m^{th}$ signal harmonic in the pressure ripple signal to obtain the magnitude $B_m$ and phase $\phi_m$ thereof;

injecting into the control system an anti-ripple signal represented by $B_m/G_m \cos(m\theta+\phi_m)$ based on $(B_m,\phi_m)$ and a gain $G_m$ from a corresponding node to a pressure node in the control system;

calculating the $m^{th}$ signal harmonic in the pressure ripple signal using spectrum analysis to obtain an updated magnitude $C_m$ and phase $\psi_m$ thereof;

calculating parameters $A_m$ and $\theta_m$ of the anti-ripple signal to be injected with respect to the $m^{th}$ signal harmonic, using the following equation:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{G_m B_m}{G_m^2 + \in} e^{j\phi_m},$$

wherein, $\in$ is an arbitrary number.

10. The anti-ripple injection method according to claim 1, wherein the anti-ripple signal is injected into a speed loop of the control system.

11. The anti-ripple injection method according to claim 1, wherein the anti-ripple signal is injected into a current loop of the control system.

12. An anti-ripple injection apparatus for injecting an anti-ripple signal into a control system of a pump, the control system controlling an electric motor via an electric motor drive, the electric motor driving the pump to produce a pump output, the anti-ripple injection apparatus comprising:

an injection module configured to inject an anti-ripple signal of any waveform into the control system, the anti-ripple signal being represented by the following equation:

$$f(\theta)=\Sigma_m A_m \cos(m\theta+\theta_m),$$

wherein $\theta$ is a rotation angle of a motor shaft, m is the order of the signal harmonic in the anti-ripple signal, $A_m$ is the magnitude of the $m^{th}$ signal harmonic, and $\theta_m$ is the phase of the $m^{th}$ signal harmonic; and a parameter determination module configured to determine $A_m$ and $\theta_m$ by extracting the corresponding parameters of the $m^{th}$ signal harmonic from a pressure ripple signal, wherein the parameter determination module includes:

a spectrum analysis sub-module configured to perform a spectrum analysis on the $m^{th}$ signal harmonic in the pressure ripple signal; and a parameter calculation sub-module configured to calculate $A_m$ and $\theta_m$ of the anti-ripple signal to be injected with respect to the $m^{th}$ signal harmonic, and wherein the anti-ripple signal causes pressure ripples in the pump output to be at least partially cancelled.

13. The anti-ripple injection apparatus according to claim 12, wherein the parameters of the anti-ripple signal are automatically set according to an output signal of a system sensor without any manual adjustment.

14. The anti-ripple injection apparatus according to claim 13, wherein the system sensor includes any one or more of the following: a pressure sensor, an angle sensor, a speed sensor, a current sensor, and a voltage sensor.

15. The anti-ripple injection apparatus according to claim 12, wherein:

the spectrum analysis sub-module is configured to perform spectrum analysis on the $m^{th}$ signal harmonic in the pressure ripple signal to obtain the magnitude $B_m$ and phase $\phi_m$ thereof;

the injection module is further configured to inject into the control system an anti-ripple signal represented by $B_m/G_m \cos(m\theta+\phi_m)$ based on $(B_m, \phi_m)$ and a gain $G_m$ from a corresponding node to a pressure node in the control system;

the spectrum analysis sub-module is further configured to calculate the $m^{th}$ signal harmonic in the pressure ripple signal using spectrum analysis to obtain an updated magnitude $C_m$ and phase $\psi_m$ thereof;

the parameter calculation sub-module is configured to calculate parameters $A_m$ and $\theta_m$ of the anti-ripple signal to be injected with respect to the $m^{th}$ signal harmonic, using the following equation:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{B_m}{G_m} e^{j\phi_m}.$$

16. The anti-ripple injection apparatus according to claim 15, wherein the parameter determination module is further configured to simultaneously perform the determination of $A_m$ and $\theta_m$ by extracting corresponding parameters of the $m^{th}$ signal harmonic from the pressure ripple signal, with respect to a set of different $m^{th}$ signal harmonics in the pressure ripple signal.

17. The anti-ripple injection apparatus according to claim 15, wherein the spectrum analysis sub-module performs spectrum analysis using a Fast Fourier Transform.

18. The anti-ripple injection apparatus according to claim 12, wherein:

the spectrum analysis sub-module is configured to perform spectrum analysis on the $m^{th}$ signal harmonic in the pressure ripple signal to obtain the magnitude $B_m$ and phase $\phi_m$ thereof;

the injection module is further configured to inject into the control system an anti-ripple signal represented by $B_m/G_m \cos(m\theta+\phi_m)$ based on $(B_m, \phi_m)$ and a gain $G_m$ from a corresponding node to a pressure node in the control system;

the spectrum analysis sub-module is further configured to calculate the $m^{th}$ signal harmonic in the pressure ripple signal using spectrum analysis to obtain an updated magnitude $C_m$ and phase $\psi_m$ thereof;

the parameter calculation sub-module is configured to calculate parameters $A_m$ and $\theta_m$ of the anti-ripple signal to be injected with respect to the $m^{th}$ signal harmonic, using the following equation:

$$A_m e^{j\theta_m} = \frac{y_1}{y_1 - y_2} x_1,$$

$$\text{wherein, } y_1 = B_m e^{j\phi_m},\ y_2 = C_m e^{j\psi_m},\ x_1 = \frac{G_m B_m}{G_m^2 + \in} e^{j\phi_m},$$

wherein, $\in$ is an arbitrary number.

* * * * *